United States Patent [19]

Moeller

[11] 4,005,888

[45] Feb. 1, 1977

[54] SECURING MEANS FOR PANELS

[75] Inventor: Axel Moeller, St. Petersburg Beach, Fla.

[73] Assignee: The Ludwig Mfg. Company, Inc., Racine, Wis.

[22] Filed: May 12, 1975

[21] Appl. No.: 576,375

[52] U.S. Cl. ..... 292/256.71

[51] Int. Cl.[2] ..... E05C 5/04

[58] Field of Search ..... 292/256.71, 155, 176, 292/152, 251

[56] References Cited

UNITED STATES PATENTS

| | | | |
|---|---|---|---|
| 741,721 | 10/1903 | Rumford | 292/256.71 |
| 1,574,222 | 2/1926 | Wensel | 292/145 X |
| 1,626,482 | 4/1927 | Sargent | 292/152 X |
| 1,653,015 | 12/1927 | Koelln | 292/152 |
| 2,247,556 | 7/1941 | Lazarides | 292/152 |
| 2,432,974 | 12/1947 | Stevens et al. | 292/256.71 X |

*Primary Examiner*—Richard E. Moore
*Attorney, Agent, or Firm*—Axel H. Johnson

[57] ABSTRACT

A means of securing a panel in an opening in a wall or the like, comprising an assembly having a body fixed to the wall adjacent to the opening. A sliding member in the body is positioned to slide over the panel, and is provided with a threaded locking member to be brought into engagement with the surface of the panel in a direction substantially normal thereto. A friction-inducing member is provided to co-operate with the sliding member and the body to reduce the tendency of the sliding member to shift when the threaded member is not engaged with the panel.

3 Claims, 16 Drawing Figures

SECURING MEANS FOR PANELS

BACKGROUND OF THE INVENTION

1. Field of the Invention.

This invention concerns a means of securing panels or the like in openings of walls.

2. Description of the Prior Art.

The prior art comprises members which are urged into contact by various means, such as springs, with the panel in order to secure the latter.

SUMMARY OF THE INVENTION

This invention provides a positive means of securing a panel in an opening in a wall; for example, a metal panel in a farm implement such as a combine. A plurality of these securing means are positioned about the periphery of the opening, and having sliding members which project over the surface of the panel. A threaded member is provided in the sliding member to be rotated into engagement with the surface of the panel to securely hold the latter in place. Frictional means is provided to prevent unecessary freedom of the sliding member when the panel is not in place, or when the wall is positioned upright. Referring to the drawings:

Figure 3:
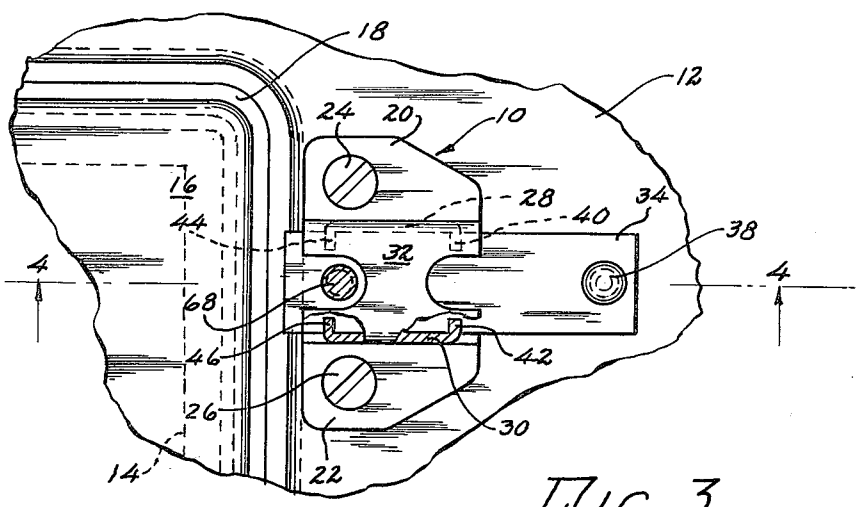
FIG. 3 is a view similar to FIG. 1, but with the sliding member withdrawn to permit the removal of the panel.

The device shown comprises a body portion 10 secured to a wall 12 which has an opening 14. In this instance, the opening 14 lies in a plane offset from the surface of the wall 12. A gasket 18 provides a seat for the panel 16.

Body portion 10 comprises wings 20 and 22 which are secured to wall 12 by screws 24 and 26, in this instance. Upwardly-extending transversely-spaced walls 28 and 30 terminate in a transverse upper portion 32.

A sliding member 34 of a suitable width, is confined between walls 28 and 30, and in contact with the lower surface of transverse portion 32. A friction-inducing member 36, of spring steel or similar material is positioned co-extensively with sliding member 34, is relatively thin and has an aperture to receive a fastening means 38, which means secures member 36 integrally with sliding member 34. Member 36 is originally "bowed" slightly as indicated at *x*, in order to provide frictional resistance to sliding of member 34 when the device has been assembled, at which time the member 36 is substantially flat.

A plurality of support lugs 40, 42, 44 and 46 are formed inwardly from the walls 28 and 30 to establish substantial contact with the lower surface of member 36 to a degree that provides sufficient friction to prevent unecessary freedom of the sliding member 34 relative to the body 10 during times of vibration of the wall 12.

Figure 7:
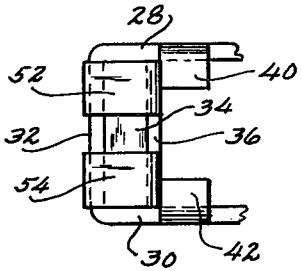
FIG. 7 is an end view of FIG. 5.
Figure 5:
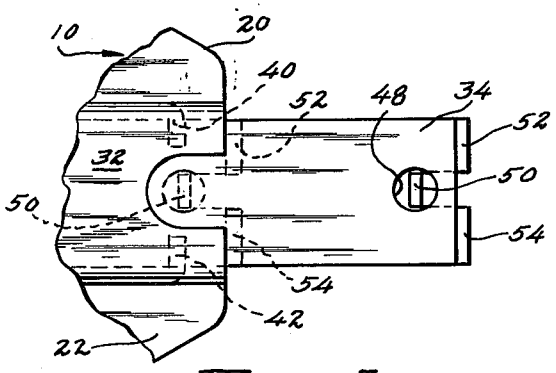
FIG. 5 is an enlarged fragmentary plan view of a modified means of securing the friction-inducing member against displacement.
Figure 6:
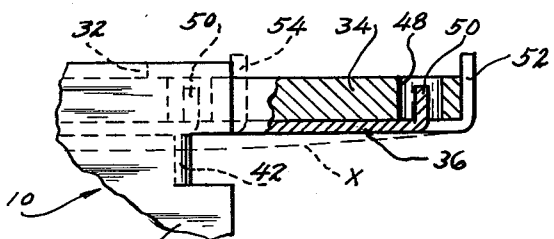
FIG. 6 is an elevational view of FIG. 5 with a portion broken away.
Figure 11:
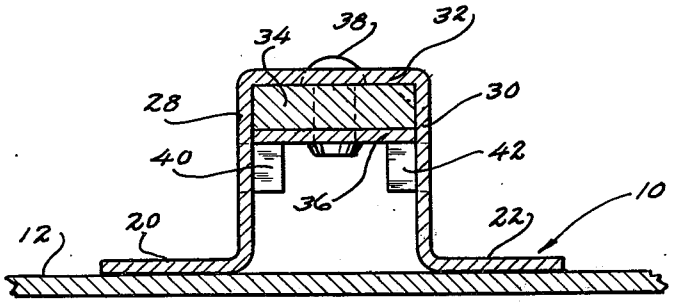
FIG. 11 is an enlarged section taken at 11—11 of FIG. 2.
Figure 12:
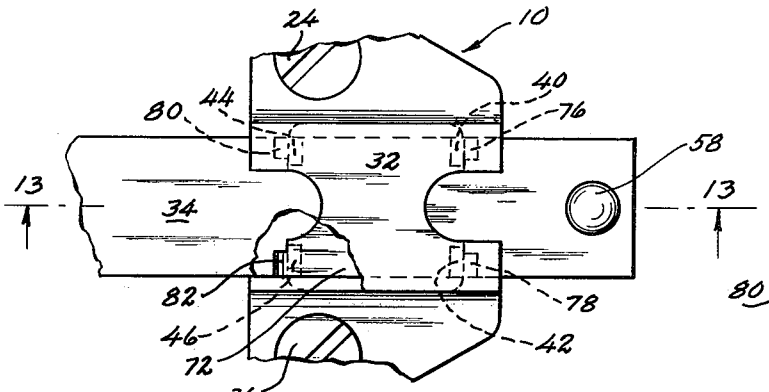
FIG. 12 is a fragmentary plan view similar to FIG. 3, and disclosing a variation in the friction-inducing member.
Figure 14:
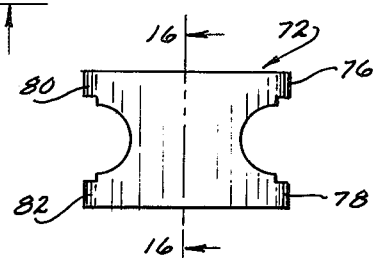
FIG. 14 is a plan view of the friction-inducing member incorporated in the assembly of FIG. 12.
Figure 16:
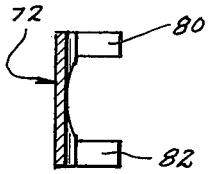
FIG. 16 is a view taken at 16—16 of FIG. 14.
Figure 15:
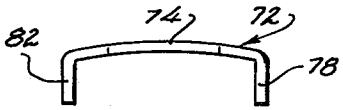
FIG. 15 is an edge view of the member of FIG. 14.

The modifications in FIGS. 5 through 10 concern means of anchoring the member 36 and to provide limit stops for the travel of sliding member 34. In FIGS. 5, 6 and 7, an aperture 48 is provided in member 34. A lug 50 is provided on member 36, which lug is inserted in aperture 48. A pair of external lugs 52 and 54 contact the extremity of sliding member 34 and function as stop means for member 34 when they contact the end of transverse portion 32.

Figure 10:
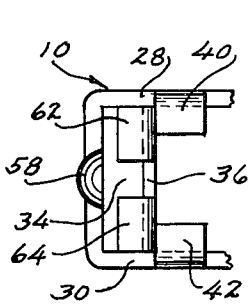
FIG. 10 is an end view of FIG. 8.
Figure 8:
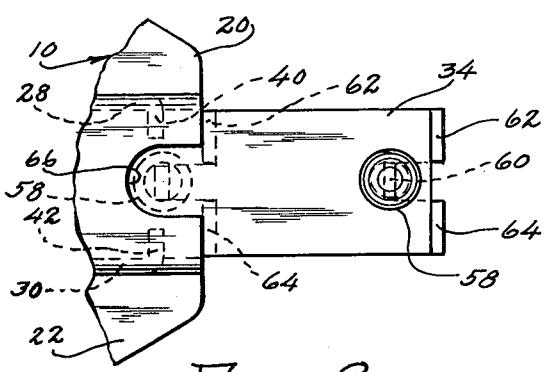
FIG. 8 shows another modification.
Figure 9:
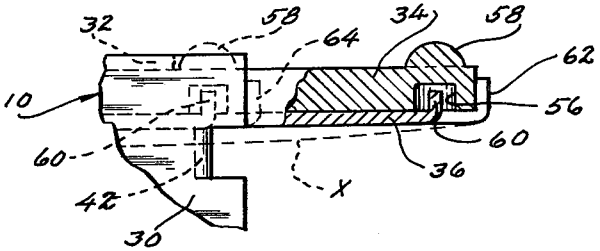
FIG. 9 is an elevational view of FIG. 8.

FIGS. 8, 9 and 10 concern another modification: A cavity 56 is formed in the lower surface of member 34, which includes a protruding portion 58. A lug 60 on member 36 is positioned in cavity 56. A pair of external lugs 62 and 64 abut the end of member 34 to prevent fore-and-aft shifting of member 36 relative to member 34. When member 34 is extended to secure the panel 16 in the wall, portion 58 contacts the portion 32, as at 66.

A threaded clamping member 68 is threadedly positioned in the foreward extremity of member 34 to provide the means of securing the panel 16 in place, as shown in FIGS. 1 through 4. A lock nut 70 is provided on threaded member 68 to provide a means of securing the threaded member 68 against loosening because of vibration.

Figure 4:
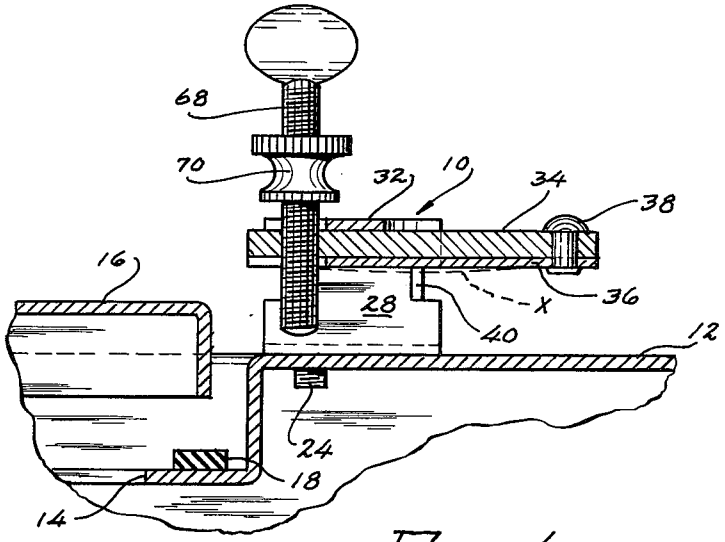
FIG. 4 is a sectional view taken at 4—4 of FIG. 3.
Figure 1:
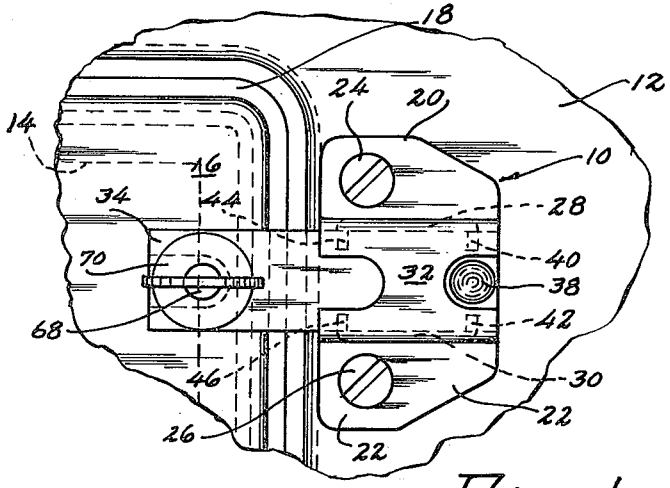
FIG. 1 is a plan view of the device mounted on a wall and securing a panel in place.
Figure 2:
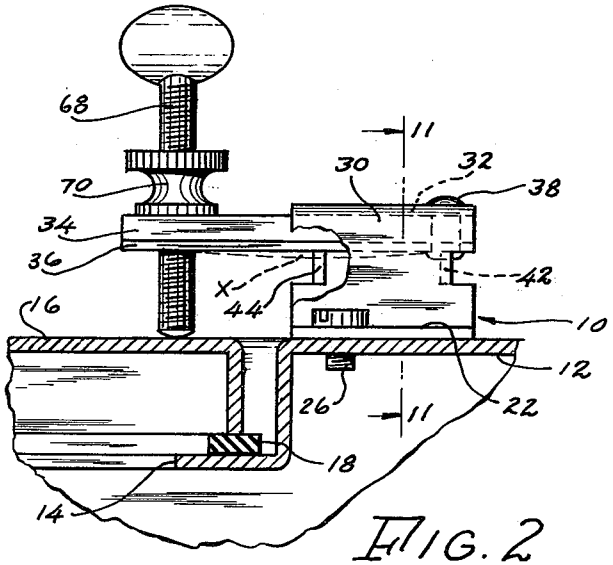
FIG. 2 is an elevational view of the means of FIG. 1.

When the panel 16 is to be secured in place in the opening 14, as shown in FIGS. 1 and 2, it is inserted in the opening, as shown in FIG. 4. When the panel has been placed as shown in FIG. 2, the sliding member 34 is then shifted over the panel to the position shown in FIGS. 1 and 2. After the threaded member 68 has been rotated to secure the panel 16 in place, lock nut 70 is securely brought into contact with the sliding member 34 as shown in FIG. 2.

Figure 13:
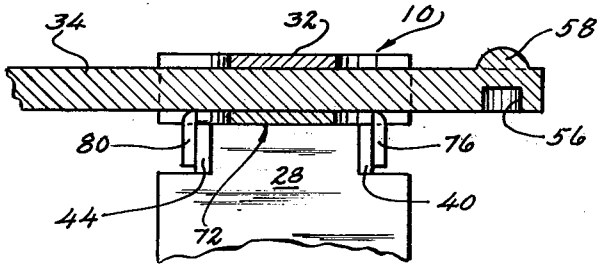
FIG. 13 is a section taken at 13—13 of FIG. 12.

A modified friction-inducing member 72 is shown in FIGS. 12 through 16, and is preferably of spring steel having an upper surface 74 which abuts the lower surface of sliding member 34. Member 72 is "bowed" upwardly in order to provide sufficient pressure to resist unecessary freedom for sliding of member 34, but assumes a substantially-flat condition when assembled with the member 34. Member 72 includes downwardly-directed lugs 76, 78, 80 and 82 which embrace support lugs 40, 42, 44 and 46, as shown in order to retain member 72 against displacement when sliding member 34 is shifted. When member 72 is assembled in contact with sliding member 34 in body 10, it resiliently assumes a substantially-flat surface in contact with that member, as shown in FIG. 13; thus providing the necessary friction to resist unecessary sliding of member 34.

While only one unit of the device is shown, it is to be understood that a plurality will be mounted at suitable positions about the periphery of the opening 14; the peripheral spacing depending upon the specific requirement.

The above being a complete description of an illustrative embodiment of the invention, what is claimed and desired to be secured by Letters Patent of the United States is:

1. A means of securing a panel in an opening in a wall, said means comprising a body portion, a sliding member embraced by said body, said sliding member having upper and lower plane surfaces and laterally-opposed edges, and being slidably confined within said body; said sliding member having a forward end and a rear end, said body having upright, laterally-spaced walls embracing said laterally-opposed edges of said sliding member, a planar friction-inducing member initially formed non-planar and in contact with said lower surface of said sliding member and mutually slidable with said sliding member, a plurality of support lugs in said body and integral with said upright walls and directed mutually inwardly and substantially normal to said walls, and engaging the lower surface of said friction-inducing member, a threaded member threadedly engaged to said sliding member at said forward end and substantially normal thereto, said threaded member positionable over said panel upon shifting of said sliding member relative to said body, and to be brought rotatively into positive engagement with the surface of said panel.

2. A means of securing a panel in an opening in a wall as set forth in claim 1, in which an aperture is provided in said lower surface of said sliding member, said friction-inducing member having an upwardly-directed lug extending into said aperture, said friction-inducing member having a plurality of upwardly-extending lugs positioned adjacent to said rear end and so as to engage said body upon forward shifting of said sliding member.

3. A means of securing a panel in an opening in a wall as set forth in claim 1, in which said friction-inducing member comprises a plurality of downwardly-directed lugs engaging said support lugs to prevent shifting of said friction-inducing member relative to said body during shifting of said sliding member.

* * * * *